US005534669A

United States Patent [19]

Schroeder et al.

[11] Patent Number: 5,534,669

[45] Date of Patent: Jul. 9, 1996

[54] TRANSPORTABLE INCUBATOR CHAMBER FOR HUMAN AND ZOOLOGICAL APPLICATIONS

[76] Inventors: Jeff Schroeder, 428 Schroeder Ave., Delevan, Wis. 53115; Gary Taylor, N3395 Beach Rd., Lake Geneva, Wis. 53147

[21] Appl. No.: 337,761

[22] Filed: Nov. 14, 1994

[51] Int. Cl.[6] ..... A47B 81/06; A61G 11/00

[52] U.S. Cl. ..... 181/198; 600/22

[58] Field of Search ..... 181/198, 207, 181/208, 209; 128/205.56; 600/22; 248/638

[56] References Cited

U.S. PATENT DOCUMENTS 4,750,474 6/1988 Dukhan et al. ..... 128/205.26

*Primary Examiner*—Khanh Dang

[57] ABSTRACT

An acoustically advanced infant incubator housing system of special value for helicopter transport. This system is comprised of an ovally shaped infant housing using double wall construction with an air space between them supported on a cradle suspension system. This process creates a superior noise and vibration rejection system, providing for a quiet chamber interior.

1 Claim, 3 Drawing Sheets

TRANSPORTABLE INCUBATOR CHAMBER FOR HUMAN AND ZOOLOGICAL APPLICATIONS

INVENTION SUMMARY

Created here is an acoustically advanced infant incubator housing system for transport and normal incubator functions.

Previous to this system, transport baby incubator design allowed much noise to enter the infant housing, causing premature babies to suffer severe noise trauma, particularly during helicopter transport. Reason for this trauma is current housing design is made up of primarily parallel and flat planes, causing sound reverberation and resonance.

The new housing system is comprised entirely of positive complex curves creating its oval shape. A sound wave hitting a curved surface like this hits only one small spot head on. This sound wave will travel down the sides of the housing. It will not only reflect off the housing but the small time delay while the sound wave travels will make it possible for the housing to handle higher SPL (Sound Pressure Level). This type of shape optimizes the strength of the materials used. This added strength makes it possible to reject more SPL and vibration before leakage into the housing occurs.

The housing features double wall construction with an air space between the layers. This is being used to enhance the noise rejection of the housing by adding three more points to aid this goal: (1) By adding the second layer we get all the qualities of the first layer and add more mass to aid the noise rejection. (2) The second layer will be different dimensionally to offer better rejection to more frequencies. (3) The air space between the layers adds an acoustic air pressure buffer between them.

The double layers are both split along the horizontal symmetry plane and connected to a tongue & groove mating system. The split is used to provide access to the inner housing. The tongue and groove is used to make the top and bottom mate and act as one solid unit similar to an egg shell.

The Suspension Cradle offers suspension to gently but firmly protect the housing from vibrations and SPL. The housing suspension features numerous suspension devices connected to the housing and the cradle. This gives a very even and gentle omnidirectional suspension of the housing from the vibrations that may be present in the Suspension Cradle. This process also allows the housing to dissipate the SPL energy by moving in relation to the pressure placed upon it.

It is to be clearly understood that this is by way of illustration only and that modifications and changes in the construction and nature of components may be resorted to without departing from the scope and spirit of the present invention.

DESCRIPTION OF THE PREFERRED EMBODIMENT

As stated above, the following detailed description describes by way of illustration a specific embodiment, this being in conjunction with the enclosed drawings, which are not according to scale.

Figure 3:
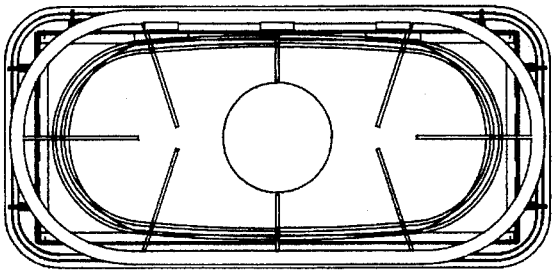
FIG. 3 Top view.
Figure 1:
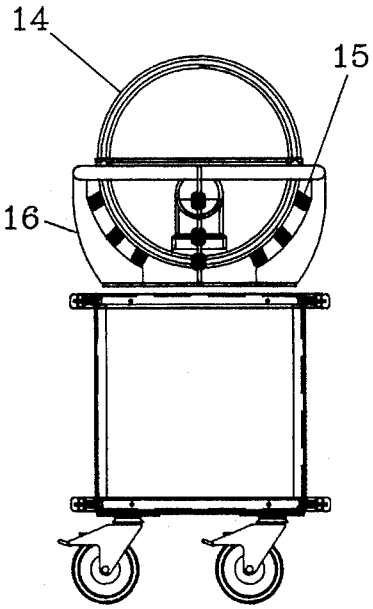
FIG. 1 Front view of the incubator.
Figure 2:
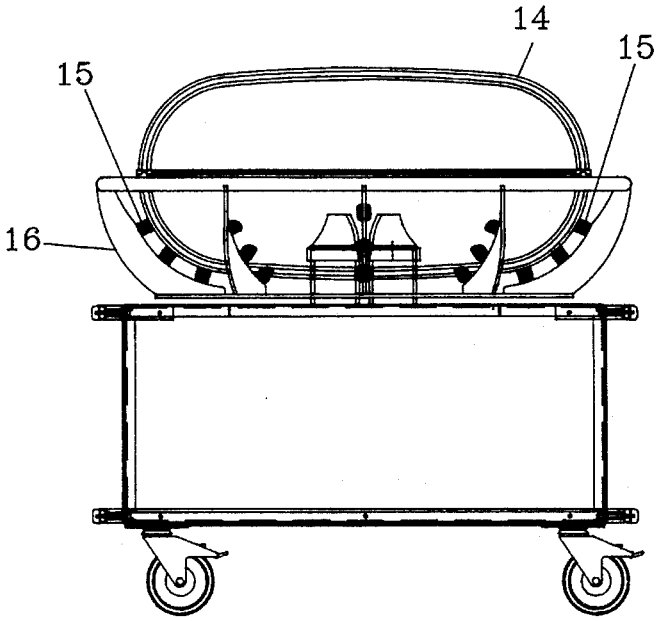
FIG. 2 Side view of the incubator.
Figure 6:
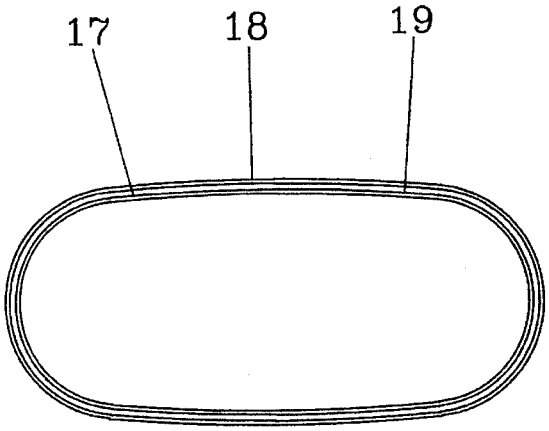
FIG. 6 Top view.
Figure 4:
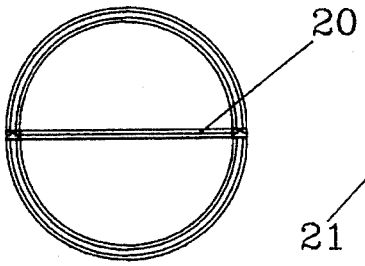
FIG. 4 Front view of elliptical housing.
Figure 5:
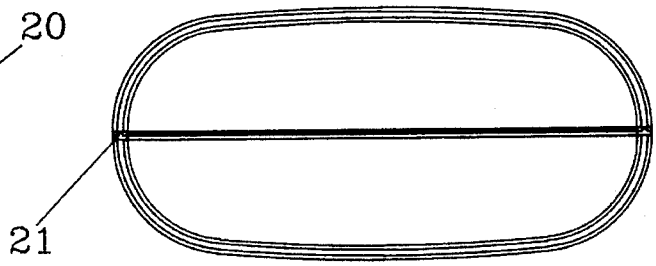
FIG. 5 Side view of elliptical housing.
Figure 7:
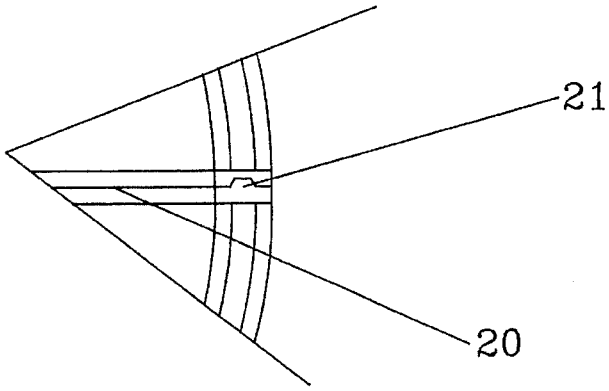
FIG. 7 Illustrates the tongue and groove mating system.
Figure 10:
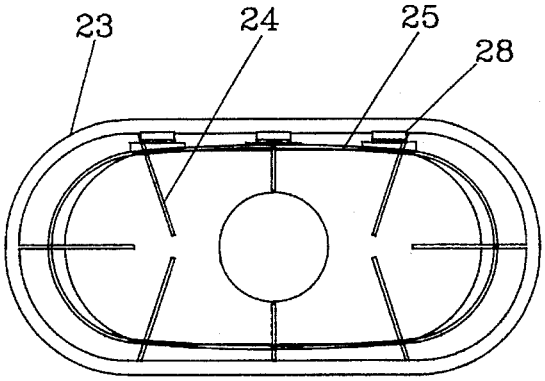
FIG. 10 Top view of cradle and housing.
Figure 8:
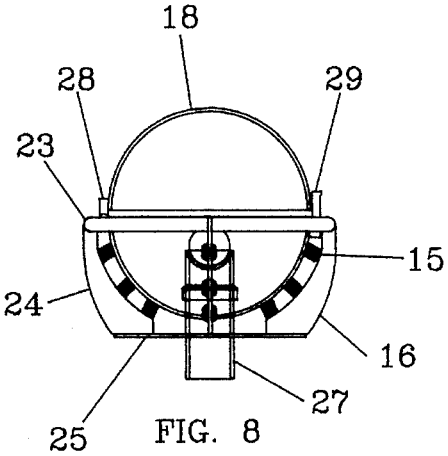
FIG. 8 Front view of housing suspended in the cradle.
Figure 9:
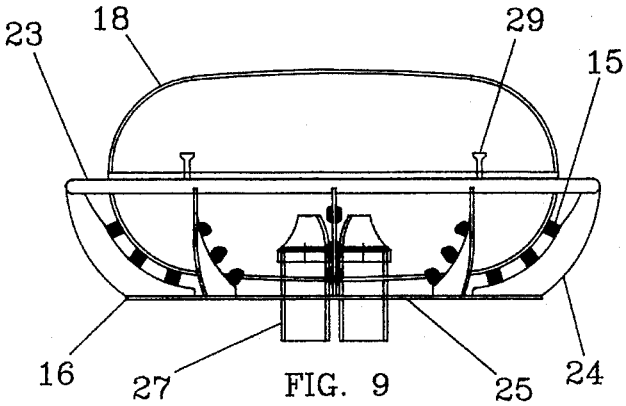
FIG. 9 Side view of housing suspended in the cradle.

As illustrated in the figures an incubator housing system according to the invention consisting of a housing 14, suspension devices 15, and cradle support assembly 16.

The housing is comprised of an inner layer 17 and outer layer 18, with an insulative airspace 19 between them. The housing shape is entirely composed of positive complex curves creating its elliptical shape. Said housing is cut along the horizontal symmetry plane 20. A tongue and groove system of mating 21 is added for the purpose of supporting the inner and outer layers, sealing the insulative air space, and the means for allowing the halves to act as a single unit when in the closed position. This split is hinged 28 along one side and has latches 29 on the other, allowing access to chamber interior and firm fastening when closed.

The cradle 16 is comprised of a rail 23 that surrounds the housing just below the housing's horizontal symmetry plane. This is held in place by approximately eight supports 24 that follow the contour of the housing on their inner edge as they reach down to the base plate 25 where they are firmly attached. There is allowed space between these supports and the housing for suspension devices 15. These devices are placed strategically on each support. Approximately three suspension devices are placed on each support. The suspension devices are applied to buffer the housing from vibration.

There exists ducts for applying an air flow temperature control system 27 through the base plate 25 and into the interior of the housing.

We claim:

1. An acoustically advanced incubator housing system for a transport incubator, said housing system comprising: a housing formed of transparent material and having an oval shape, said housing comprising double walled upper and lower halves, a tongue and groove system for mating said housing halves, means for hinging and latching for opening and closing of said housing halves, a cradle system for supporting said housing, said cradle system comprising a top rail, a bottom mounting plate, and a plurality of supports connecting the top rail to the bottom mounting plate, a plurality of suspension means provided between said housing and said cradle system for isolating vibration and noise pressure levels from the interior of said housing, and means for providing air flow to said housing for establishing normal incubator conditions.

* * * * *